US007987654B1

(12) United States Patent
Eckert

(10) Patent No.: US 7,987,654 B1
(45) Date of Patent: Aug. 2, 2011

(54) METHODS AND SYSTEMS FOR SHIPPING, PACKAGING AND/OR DISPLAYING KAYAKS AND OTHER SPORTING GOODS

(75) Inventor: Thomas Eckert, Rancho Cucamonga, CA (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 12/431,613

(22) Filed: Apr. 28, 2009

Related U.S. Application Data

(63) Continuation of application No. 11/688,361, filed on Mar. 20, 2007, now Pat. No. 7,523,598.

(60) Provisional application No. 60/784,521, filed on Mar. 20, 2006.

(51) Int. Cl.
*B65B 3/04* (2006.01)

(52) U.S. Cl. ..... 53/474; 53/446; 53/238

(58) Field of Classification Search ..... 53/473, 53/474, 475, 445, 147, 238, 241, 247, 260
See application file for complete search history.

(56) References Cited

U.S. PATENT DOCUMENTS

| | | | | |
|---|---|---|---|---|
| 2,126,106 | A | | 8/1938 | Goldberg |
| 2,701,089 | A | | 2/1955 | Fischer |
| 3,343,659 | A | | 9/1967 | Marondel |
| 3,372,813 | A | | 3/1968 | Ishida |
| 3,860,305 | A | | 1/1975 | Bergman |
| 3,863,829 | A | | 2/1975 | Merrill |
| 4,483,380 | A | | 11/1984 | Beran |
| 4,589,365 | A | | 5/1986 | Masters |
| 5,405,002 | A | | 4/1995 | Troia |
| 5,415,343 | A | | 5/1995 | Vosbikian |
| 5,573,115 | A | * | 11/1996 | Fuller ..... 206/362.4 |
| 5,810,177 | A | | 9/1998 | Cabiran |
| 5,842,566 | A | | 12/1998 | White |
| 6,112,692 | A | | 9/2000 | Lekhtman |
| 6,315,177 | B1 | | 11/2001 | Weatherall |
| 6,325,014 | B1 | | 12/2001 | Blanchard |
| 6,427,842 | B1 | | 8/2002 | Green |
| 6,681,968 | B2 | | 1/2004 | Zwagerman |
| 6,745,716 | B2 | | 6/2004 | Belyeu |
| 6,837,378 | B2 | | 1/2005 | Mason et al. |
| 6,863,014 | B2 | | 3/2005 | Hudson et al. |
| 7,523,598 | B1 | | 4/2009 | Eckert |
| 2003/0106835 | A1 | | 6/2003 | Hubbs et al. |
| 2006/0254495 | A1 | | 11/2006 | Eckert |

* cited by examiner

*Primary Examiner* — Paul R Durand
(74) *Attorney, Agent, or Firm* — Workman Nydegger

(57) ABSTRACT

Methods and systems for packaging sporting goods are provided. Embodiments advantageously preserve sporting goods, such as kayaks, against damage during transportation, ease handling of the sporting goods while being transported, and enable easy conversion from a shipping mode to a display mode. Further, embodiments conserve floor space during storage, shipping, and display while preventing sporting goods from collapsing or falling over.

16 Claims, 4 Drawing Sheets

METHODS AND SYSTEMS FOR SHIPPING, PACKAGING AND/OR DISPLAYING KAYAKS AND OTHER SPORTING GOODS

CROSS-REFERENCE TO RELATED APPLICATIONS

This application is a continuation of U.S. patent application Ser. No. 11/688,361, filed on Mar. 20, 2007 Now U.S. Pat. No. 7,523,598, which claims the benefit of priority under 35 U.S.C. §119(e) of U.S. Provisional Patent Application No. 60/784,521, filed on Mar. 20, 2006, both of which are incorporated herein by reference.

BACKGROUND OF THE INVENTION

1. Field of the Invention

This invention generally relates to methods and systems for shipping, packaging and/or displaying sporting goods, and in particular, relates to methods and systems that facilitate shipping, packaging and/or displaying of sporting goods with an elongated body such as recreational kayaks and other watercrafts.

2. Description of the Related Art

Certain sporting goods such as recreational kayaks, surfboards and other watercrafts are expensive to transport and store primarily because of their size and configuration. For example, recreational kayaks typically have an elongated body with tapered or curved end portions which make them particularly costly to transport and store. These kayaks are usually wrapped in individual plastic bags and stacked on the floor, shelves, or racks, or leaned up against a pole or wall during storage. Thus, they tend to take up significant floor space in both trucking and distribution centers. Shipping and storage costs of large items such as these recreational kayaks are of particular concern to manufacturers, trucking companies, distributors and store retailers. Further, kayaks leaning against or stacked on top of one another during transport or storage could also potentially cause damage to each other. Additionally, the current practice limits the space in which the products can be presented to a retail customer for sale.

In view of the foregoing, it will be appreciated that there is a need for an improved method and system for packaging, shipping and/or displaying sporting goods such as recreational kayaks. To this end, there is a particular need for a method and system for packaging kayaks and other sporting goods in a manner that substantially reduces the amount of truck space required and/or allow retailers and distribution centers to handle and store the products in a simple and manageable package.

SUMMARY OF THE INVENTION

In one aspect, the preferred embodiments of the present invention provide a method of packaging, shipping, and/or displaying sporting goods such as recreational kayaks and other watercrafts having an elongated configuration. The method generally comprises standing each individual article, for example kayak, in a substantially upright position. The upright orientation permits the articles to be positioned closely to one another to conserve space without exerting any substantial force on each other to cause damage. In one embodiment, the method includes standing each individual kayak on one end in an upright position inside a truck or storage warehouse and positioning the kayaks immediately adjacent one another to conserve space. In one preferred implementation, the method utilizes a stabilizing member which is configured to stabilize an individual kayak so that it can stand in an upright position on one end without toppling over. The stabilizing member can include a variety of different devices including racks, short individual boxes on the end of each kayak, molded foam blocks fitted on the end of each kayak, or any other devices to allow the kayak to stand stable on its end in an upright manner.

In another aspect, the preferred embodiments of the present invention provide a stand alone shipping and product display system adapted for sporting goods such as recreational kayaks or other watercraft with an elongated body. In one embodiment, the system comprises an open-top container and a pallet attached to a lower surface of the container. Individual kayaks wrapped in plastic can be positioned upright inside the open-top box during shipment and storage. Preferably, the container is configured to keep the kayaks in an upright position and yet expose to view at least half of the length of the kayak. Inside the retail stores, the plastic wraps can be simply removed from the kayaks and the container functions as a point of sale display for the kayaks. The shipping and product display system can also be easily moved to and from by a fork truck or other similar equipment.

DETAILED DESCRIPTION OF THE PREFERRED EMBODIMENT

Figure 1A:
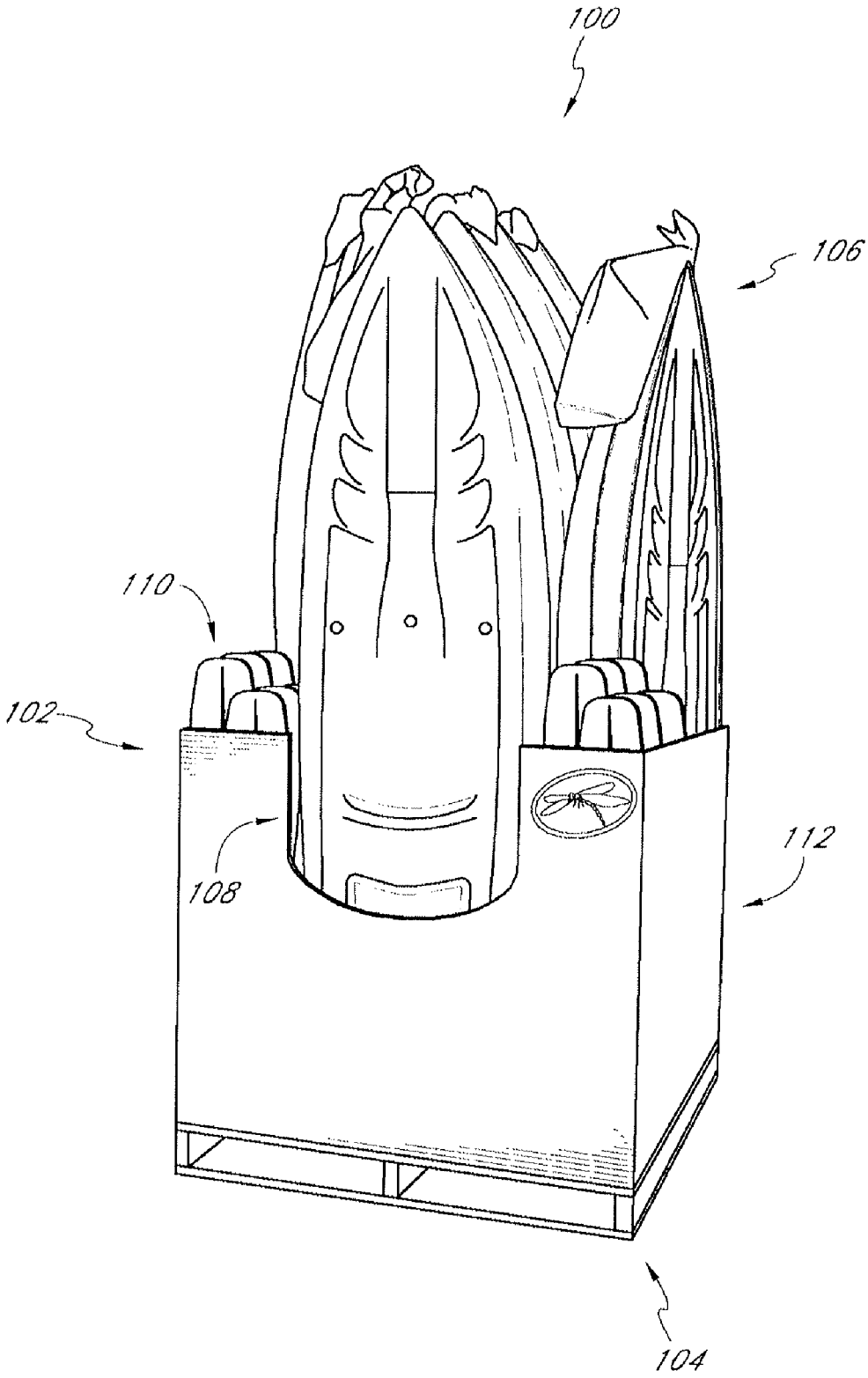
FIGS. 1A-B illustrate embodiments of a system and method for packaging, shipping, and/or displaying sporting goods such as recreational kayaks.

FIG. 1A provides an illustration of a system and method for packaging, shipping, and/or displaying sporting goods such as recreational kayaks. As shown in FIG. 1A, the system 100 comprises a display container 102 and a pallet 104 attached to a lower surface of the container 102. In one embodiment, the display container 102 is preferably a heavy corrugated open-top container, such as a short box, and the pallet is a disposable cartage pallet. In a preferred implementation, the display container has a height that is less than or equal to half of the length of a kayak stored therein. Such a configuration allows a substantial portion of the kayak to be viewed by a retail customer when the container is in a display mode, but also provides sufficient lateral support to prevent the items from toppling or collapsing when the container is being transported. In a non-limiting example, the container has a length of about 48 inches, a width of about 48 inches and a height of about 40 inches and the pallet is about 48 inches by about 48 inches. However, it will be appreciated that the configuration and dimensions of the container and the pallet can vary without departing from the scope of the invention.

Figure 1B:
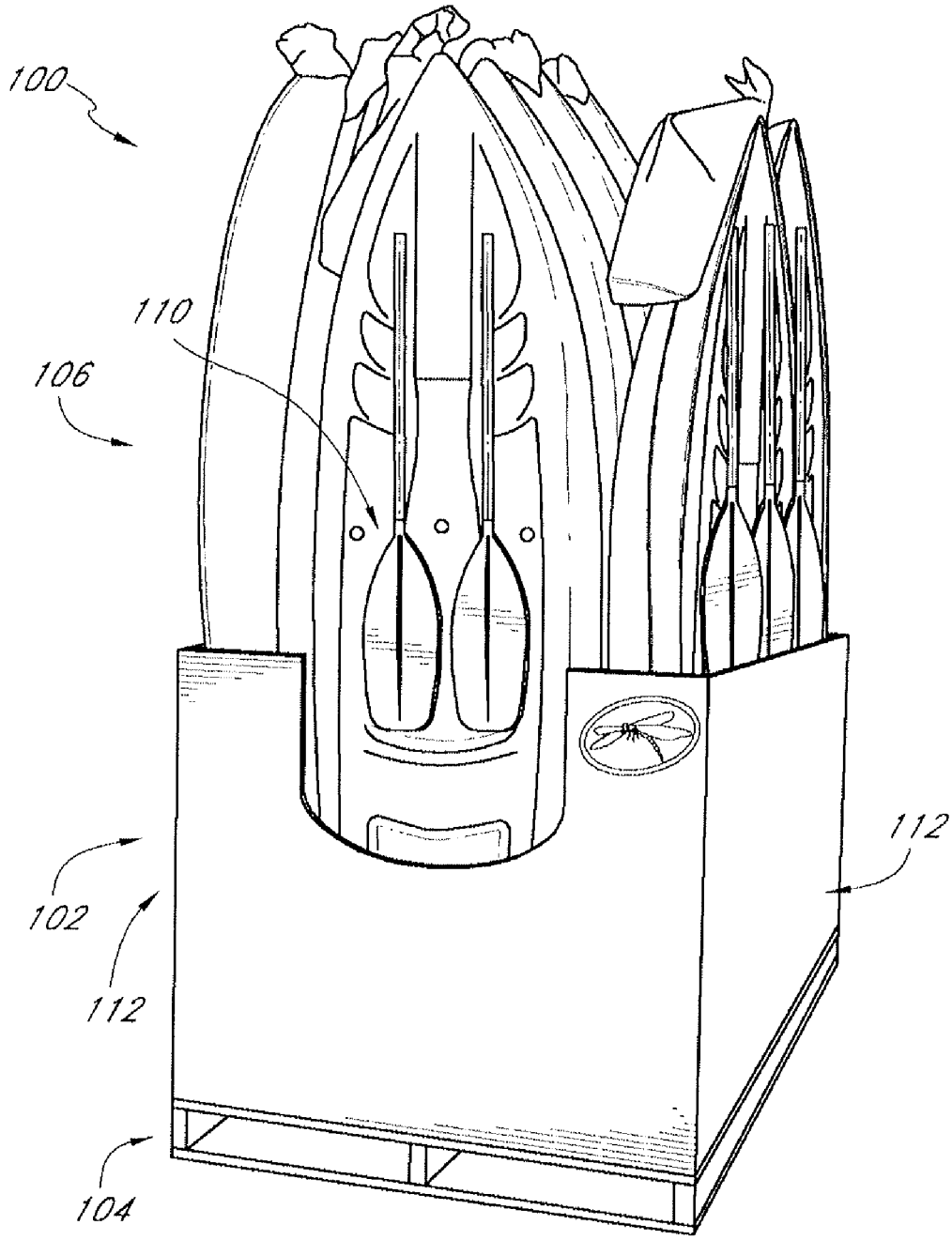

As shown in FIG. 1A, a plurality of kayaks 106 can be arranged in an upright position inside the container 100 to form a multi-unit package. In one embodiment, the kayaks 106 are positioned directly into the container. In another embodiment, the lower end portion of some or all of the kayaks 106 is additionally supported by a foam block or other similar devices to help the kayaks stand in an upright position. Further, the upper portion of some or all of the kayaks may be supported and spaced apart from other kayaks by foam blocks or other similar devices to protect the kayaks. As also shown in FIG. 1A, the system also allows for different models of kayaks to be assembled together in one package with kayak paddles 110 as a complete product shipper and/or sales display. Once in the retail store, the plastic wrap around each kayak can be removed and the container becomes a readily available product display box. As shown in FIG. 1A, an opening 108 can be formed on a side of the container so that a larger portion of the kayak design can be exposed to customers. FIG. 1B illustrates another embodiment of the system and method in which the paddles 110 are attached to each individual kayak 106.

Advantageously, the systems and methods of packaging and/or displaying kayaks as shown in FIGS. 1A-B provide a process for shipping and storing kayaks that requires less space in a truck. The systems and methods taught herein also provide benefits to retailers and distribution centers in that they allow handling and storage of the product in a simple and manageable package that can be easily accessed and moved with a fork lift or hand truck. Additionally, the systems and methods benefit retailers and distributors in that they can use the shipping packaging as a point of purchase display after only removing certain outer protecting covering from the kayaks. Desirable promotional indicia 112, such as graphics or artwork, can also be applied to the package to enhance appeal to the consumer.

Figure 2:
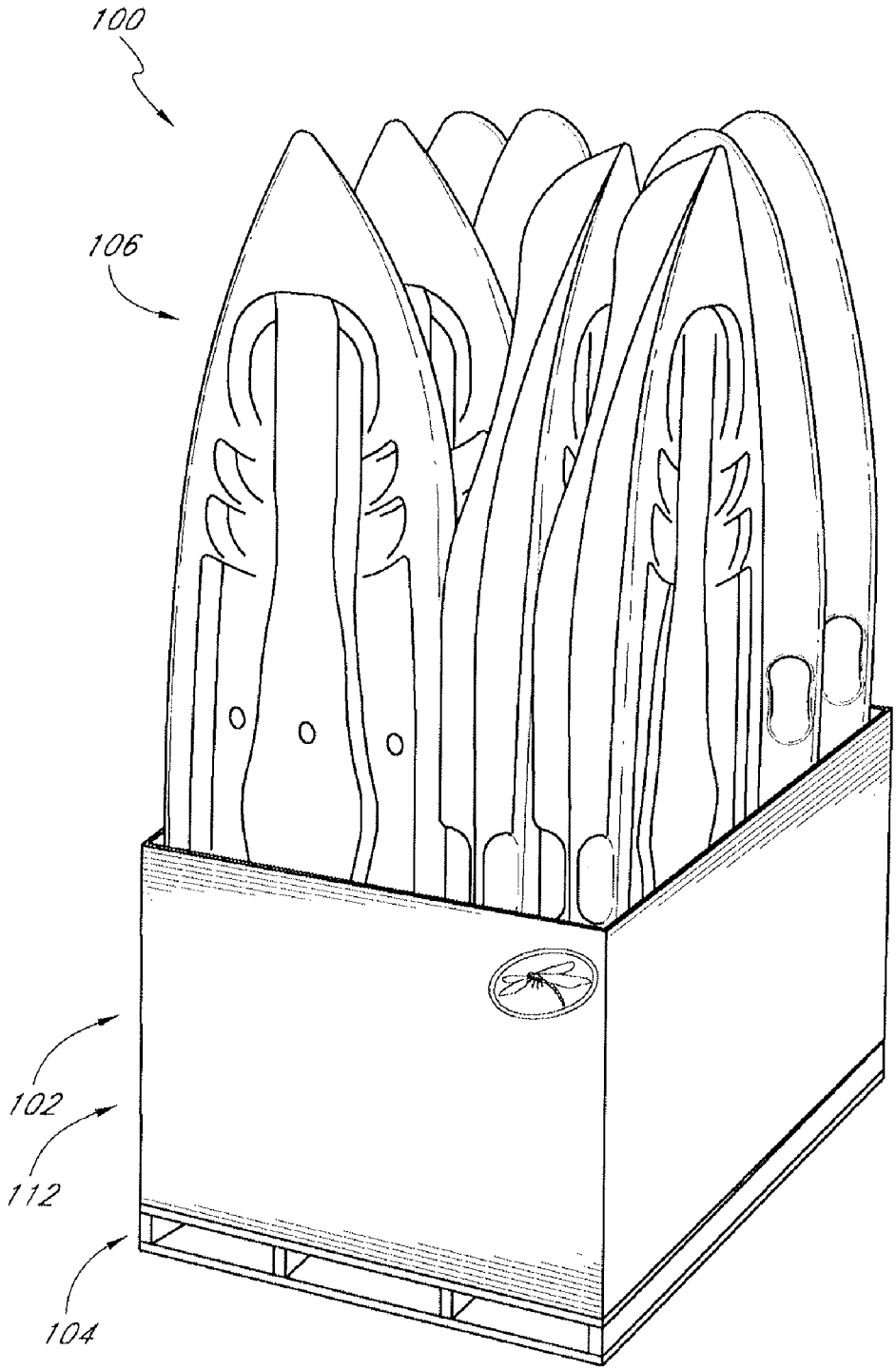
FIG. 2 illustrates another embodiment of a system and method for packaging, shipping, and/or displaying sporting goods such as recreational kayaks.

Further, the systems of the preferred embodiments allow the retailer to maximize usage of floor space in the store by placing the products in any area of the store and even in outdoor regions close to the storefront. The arrangement of products in this stand on end fashion allows a simple portability by hand truck or fork lift to any location desired. It also allows the products to be easily returned to the inside of the store for security when the store is closed. The system also allows the products to be easily stored in a warehouse and back room for more efficient use of floor space. FIG. 2 illustrates another embodiment of the system and method of packaging, storing, and/or displaying sporting goods such as kayaks. Preferably, the plastic covering material has been removed from each kayak when the kayaks are displayed in a retail setting as shown in FIG. 2. Preferably, the kayaks are positioned in the display box in a manner such that upper sides of the kayaks are visible from all four sides of the display box. Advantageously, the container 102 can be interchangeably used as both a display container and a shipping container.

Figure 3:
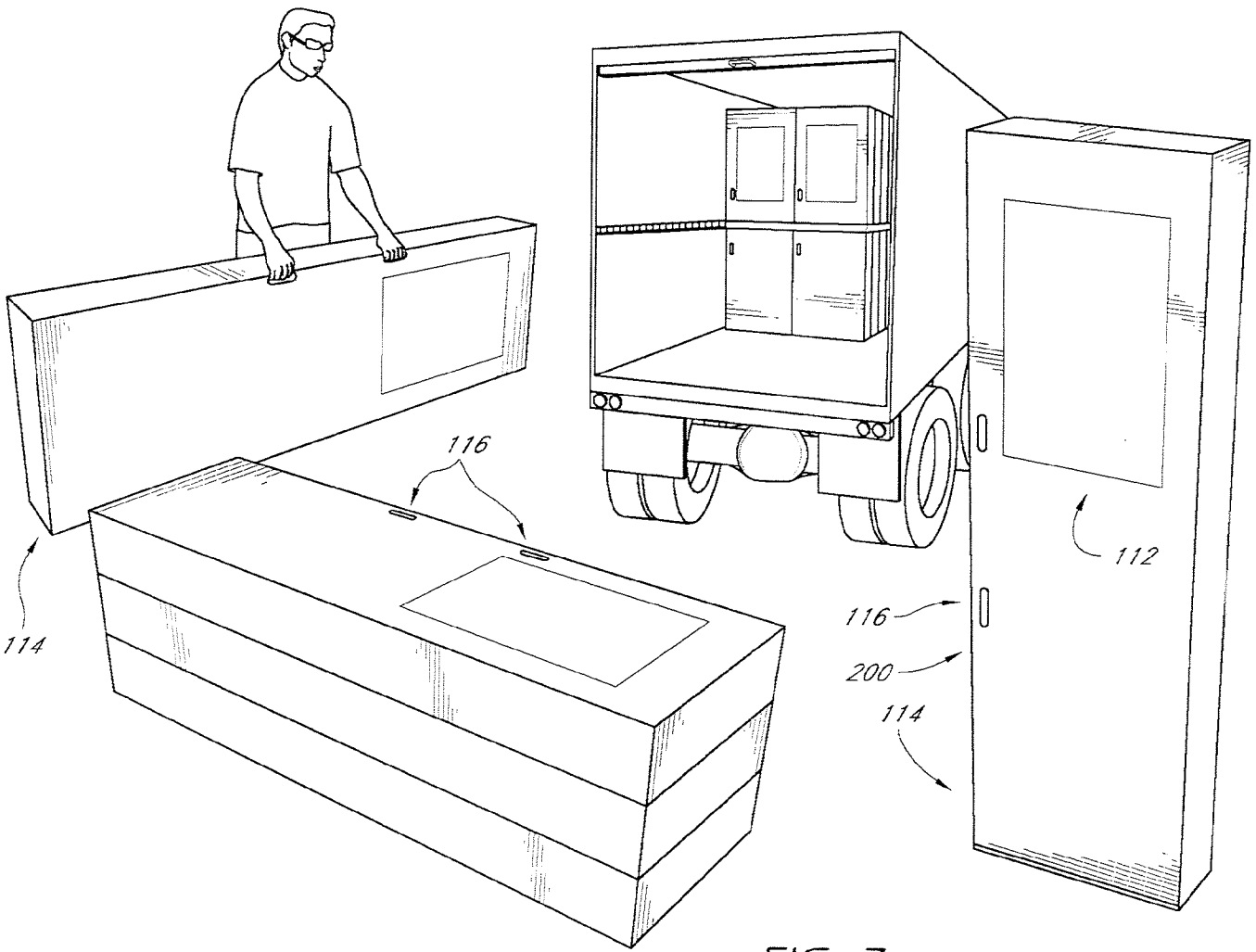
FIG. 3 illustrates yet another embodiment of a system and method for packaging and/or shipping sporting goods such as recreational kayaks.

The kayaks and other elongated sporting goods can be shipped together in a multi-unit package arrangement as described above or can also be shipped individually in a predetermined upright position to use less space in shipping and storage. FIG. 3 illustrates another system and method in which kayaks and other elongated sporting goods can be shipped. As shown in FIG. 3, individual kayaks are positioned in elongated, substantially rectangular containers 200. Preferably, each container has at least two substantially planar opposing sides which facilities stacking or positioning the containers against one another during shipping. The container may include a foam block at one or both ends of the kayak to stabilize and protect the kayak. The containers may also include a paddle for use with the kayak. As illustrated in FIG. 3, the containers 200 may include carrying handles 116 to assist a handler in manually moving the containers 200. The containers 200 can be positioned upright inside a truck, which significantly reduces the amount of truck space required. Furthermore, the containers 200 can also be stacked flat. The exterior of the container 200 may include promotional indicia 112 to enhance consumer appeal and/or shipping indicia 114 to indicate the correct position for shipping the container. In one implementation, the container comprises a carton. Preferably, the carton has a length of about 96.5 inches and a width of about 30 inches and a depth of about 10 inches.

Although the foregoing description of the preferred embodiments of the present invention has shown, described and pointed out the fundamental novel features of the invention, it will be understood that various omissions, substitutions, and changes in the form of the detail of the invention as illustrated as well as the uses thereof, may be made by those skilled in the art, without departing from the spirit of the invention. Particularly, it will be appreciated that the preferred embodiments of the invention may manifest itself in other shapes and configurations as appropriate for the end use of the article made thereby.

What is claimed is:

1. A method of packaging a plurality of kayaks, each of the plurality of kayaks having an elongated configuration with a first end and a second end, the method comprising:

providing a container comprising a plurality of sidewalls, a substantially open top portion, a substantially closed bottom portion, and a pallet attached to the substantially closed bottom portion;

standing each of the plurality of kayaks in the container to rest the first end on the bottom portion and extend at least a portion of each of the plurality of kayaks through an opening in the top portion;

orienting each of the plurality of kayaks in a substantially upright orientation in a manner such that at least two of the kayaks are positioned side by side and face the same sidewall of the container; and stabilizing the plurality of kayaks to maintain the substantially upright orientation.

2. The method of claim 1, wherein orienting each of the plurality of kayaks in a substantially upright orientation comprises orienting each of the plurality of kayaks within about 10 degrees of a vertical orientation.

3. The method of claim 1, wherein standing each of the kayaks comprises extending at least 50% of the length of each of the kayaks through an opening in the top portion.

4. The method of claim 1, wherein the plurality of kayaks comprises kayaks of different sizes.

5. The method of claim 1, further comprising standing a plurality of paddles in the container.

6. The method of claim 1, wherein stabilizing the plurality of kayaks comprises closely packaging the plurality of kayaks such that the substantially upright orientation of each of the kayaks is supported by an adjacent kayak.

7. The method of claim 1, wherein stabilizing the plurality of kayaks comprises fitting the first end of each of the kayaks in a foam block on the bottom portion of the container.

8. The method of claim 1, wherein the pallet comprises a disposable cartage pallet.

9. The method of claim 1, wherein providing an open top container comprises displaying promotional indicia on an exterior portion of the container.

10. The method of claim 1, further comprising wrapping at least some of the kayaks in a protective covering, wherein the protective covering can be removed from the kayaks without removing the sporting goods from the container.

11. A method of packaging a kayak having an elongated configuration, comprising:

standing the kayak on a first end to orient a major axis of the kayak in a substantially upright orientation, wherein the major axis is the axis along which the kayak is elongated;

stabilizing the kayak;

housing the kayak in an elongated container;

providing a paddle in the container; and standing the elongated container in a substantially upright orientation.

12. The method of claim 11, wherein housing the kayak comprises placing the kayak in a container formed of corrugated cardboard.

13. The method of claim 11, wherein stabilizing the kayak comprises positioning the first end of the kayak in a foam block.

14. The method of claim 11, further comprising providing indicia on the container indicating a correct position for shipping the container, wherein the correct position is in a substantially vertical orientation.

15. The method of claim 11, wherein the container comprises a carton having at least six sides, and wherein at least two handles are formed within a same one side of the at least six sides.

16. The method of claim 11, wherein the stabilized kayak within the container is supported such that the kayak and elongated container are resistant to toppling over.

* * * * *

UNITED STATES PATENT AND TRADEMARK OFFICE

CERTIFICATE OF CORRECTION

PATENT NO. : 7,987,654 B1
APPLICATION NO. : 12/431613
DATED : August 2, 2011
INVENTOR(S) : Eckert It is certified that error appears in the above-identified patent and that said Letters Patent is hereby corrected as shown below:

Column 2
Line 60, change "container 100" to --container 102--

Column 3
Line 56, change "facilities" to --facilitates--

Signed and Sealed this
Third Day of April, 2012

David J. Kappos

David J. Kappos
*Director of the United States Patent and Trademark Office*